United States Patent [19]

Delgado, Jr.

[11] 4,351,372

[45] Sep. 28, 1982

[54] LIQUIFIED GAS PUMPING AND CYLINDER RE-FILL SYSTEM

[76] Inventor: Manuel O. Delgado, Jr., 1618 King Dr., New Orleans, La. 70122

[21] Appl. No.: 83,825

[22] Filed: Oct. 11, 1979

[51] Int. Cl.[3] ..... B65B 3/04

[52] U.S. Cl. ..... 141/2; 141/5; 141/18; 141/285; 141/83; 222/318; 417/403

[58] Field of Search ..... 417/403; 141/1-7, 141/250-284, 285-310, 83, 59, 37-58, 60-66, 18-29; 222/318

[56] References Cited

U.S. PATENT DOCUMENTS

| | | | |
|---|---|---|---|
| 565,615 | 8/1896 | Grossman | 417/403 |
| 2,606,696 | 8/1952 | Miner | 417/403 |
| 2,652,961 | 9/1953 | Sherbondy | 417/403 |
| 3,776,252 | 12/1973 | Wilcox | 417/403 |

*Primary Examiner*—Houston S. Bell, Jr.
*Attorney, Agent, or Firm*—C. Emmett Pugh and Associates

[57] ABSTRACT

A pumping system for filling pressurized gas cylinders from a relatively lower pressure, liquified supply of that gas, for example $CO_2$, by means of a system comprising a $CO_2$/air-driven motor driving the liquified gas into the cylinder. The system is primed until liquid begins to run. Thereafter the liquid is driven by the $CO_2$/air-driven motor into an empty cylinder. A particularly efficacious longitudinally reciprocating plunger pump for use in the system is disclosed (FIG. 4). The "air" driven motor is preferrably driven by $CO_2$ vapor, particularly where $CO_2$ is the liquified gas being pumped or where hazardous or toxic liquified gases are being pumped.

8 Claims, 5 Drawing Figures

LIQUIFIED GAS PUMPING AND CYLINDER RE-FILL SYSTEM

BACKGROUND OF THE INVENTION

1. Field of Invention

The present invention involves a method and apparatus for the rapid filling of a cylinder from a low pressure liquified supply chamber of a gas such as for examples $CO_2$, "Halon", "Freons" (halo-carbons), fuel gases (propane, butane, etc.), toxic gases (chlorine, ammonia, sulphur dioxide, etc.)

2. General Background

Under present technology, it is extremely difficult, expensive and time-consuming to fill liquified gas cylinders. The present invention's method of transferring the desired liquified gas to cylinders in contrast is an inexpensive, rapid, safe and efficient system of transfer.

3. General Discussion of the Present Invention

The present invention comprises a system for filling high pressure liquified gas cylinders from low pressure liquified gas bulk containers. Besides the rapid, efficient, transfer of liquified gas, the system has a number of safety features built into it.

In the preferred embodiment of the system of the present invention a suction valve is attached to a conduit leading out of a liquid storage chamber. Between the liquified gas and the suction valve is for example a pop safety valve. The liquified gas is then drawn up into the pump. A primer valve (equipped with a rupture disk) is opened and kept open until liquid begins to flow. The primer valve is then closed.

The liquified gas continues to flow through the system by pump action and a three-way selector ball valve (in a first embodiment) is opened allowing the liquid to flow back into the liquid storage chamber. (This conduit is also equipped with a pop safety valve.)

A valve is opened to a $CO_2$ vapor or air supply. The gas powers the $CO_2$/air-driven motor drives the pump system.

At this point a cylinder is attached at the other end of the system by means of a cylinder connector. The cylinder can be connected either to a conduit or directly to the three-way ball selector valve. The cylinder is placed on a scale.

The three-way ball selector valve is opened towards the cylinder, to allow a filling of the cylinder. The cylinder is filled when its weight matches its listed weight when full. The pressure to the motor is reduced. The three-way ball selector valve is then reset to maintain circulation only within the system.

After this the cylinder connector is disconnected, and another cylinder is placed on the scale, ready to be filled.

Another aspect of the present invention is that it uses absolutely no electricity when using for example $CO_2$ vapor as the power source for the pump's motor, as compared to air which would require a compressor which could be electrically driven, or explosion proof electric motor drives required when pumping liquified fuel gases or other hazardous gases by direct drive electric motor pumps.

Additionally, the invention includes a pumping mechanism that utilizes a longitudinally reciprocating cupped plunger or piston with ball checked inlet and outlet valves, which is driven preferrably by $CO_2$ vapor, particularly when $CO_2$ is the liquified gas being pumped or when the liquified gas being pumped is a hazardous one and $CO_2$ vapor is readily available as is usually the case.

BRIEF DESCRIPTION OF THE DRAWINGS

For a further understanding of the nature and objects of the present invention, reference should be had to the following detailed description, taken in conjunction with the accompanying drawings, in which like parts are given like reference numerals.

DETAILED DESCRIPTION OF THE PREFERRED EMBODIMENTS

Figures 1, 2:
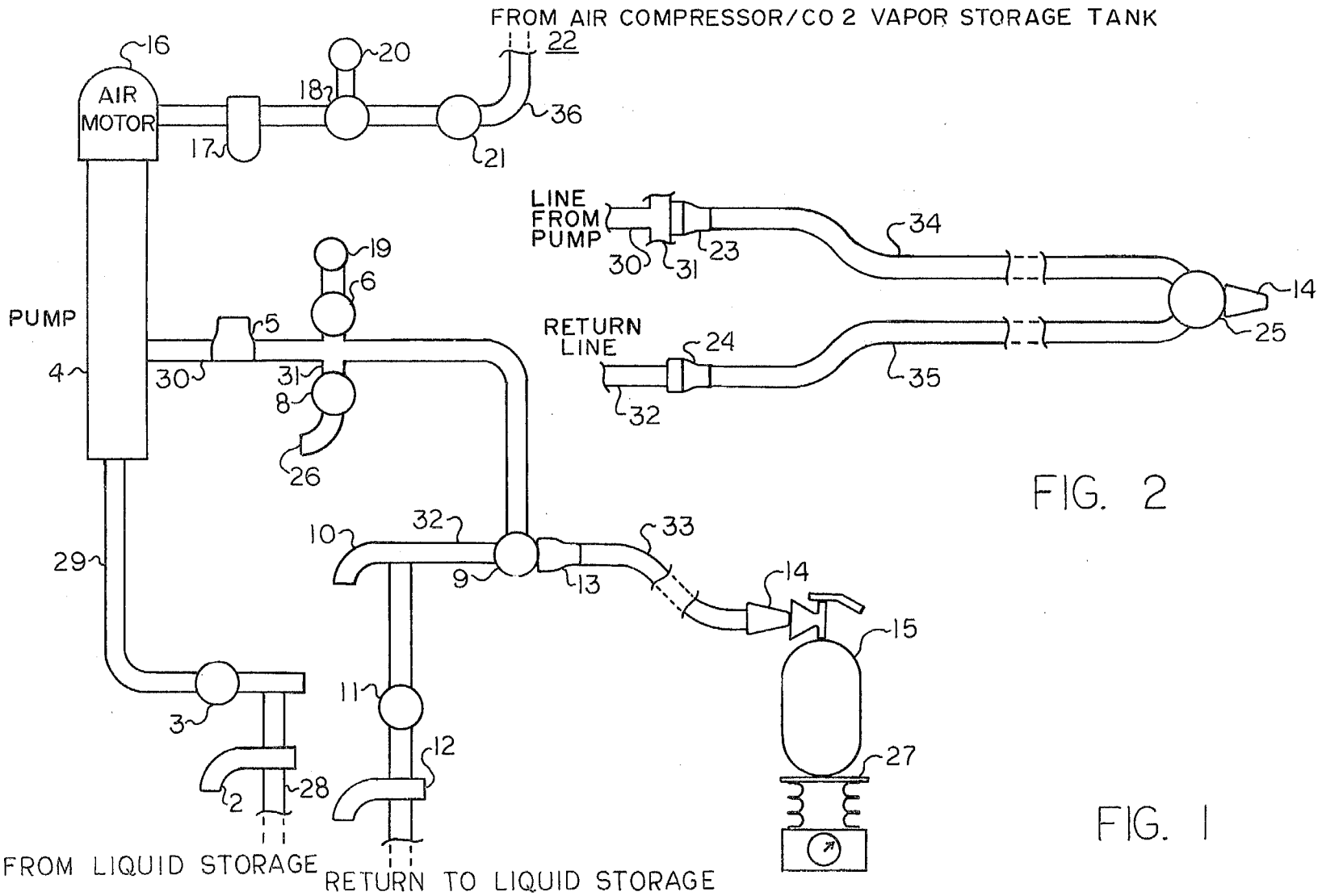
FIG. 1 is a schematic diagram of a first manual system, designated "A", as one of the preferred embodiments of the present invention showing the 3-way valve close to the system with a conduit to the liquified gas cylinder (in this example, $CO_2$).
FIG. 2 is a schematic diagram of the terminal portion of a second manual system, designated "B", as a second preferred embodiment showing the three-way ball selector attached directly to the cylinder connector, returning liquid back to storage.
Figure 3:
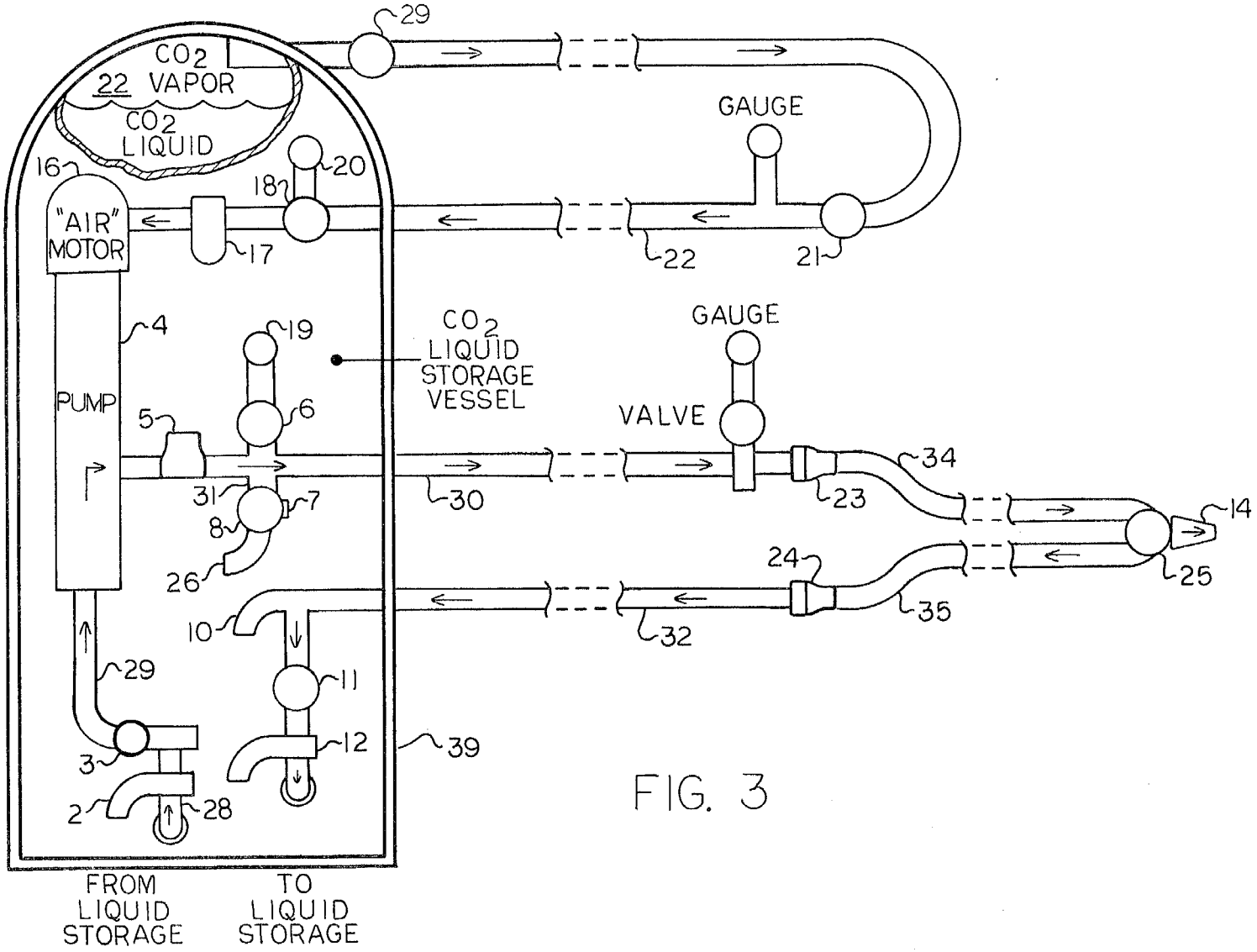
FIG. 3 is a schematic diagram of the manual system "B" of FIG. 2 with the pump, air/$CO_2$ vapor motor and most of the system at the liquified gas storage facility, with the power to drive the motor coming from the $CO_2$ vapor produced inside the liquid $CO_2$ storage chamber, but with the cylinder connector at a remote location.

There are two preferred embodiments of the system of the present invention illustrated herein, namely that of FIG. 1 (System "A") and that of FIGS. 2 and 3 (System "B" close-in and remote, respectively). This sequential operation of each embodiment will now be described.

In FIG. 1, the liquid is initially drawn up from the relatively low pressure, liquid storage chamber 1 through a pipe 28 past a pop safety valve 2, when suction valve 3 is opened. The liquified gas then flows through pump chamber 4 into pipe 30 going through and past surge chamber 5 which smooths the pressure delivery of the fluid.

At this point primer valve 8, containing rupture disk 7, is opened for priming to let the liquified gas flow through pipe 31 until liquid starts to flow out of opening 26. When liquid starts to flow, the pump 4 is primed and valve 8 is closed. Three-way valve 9 is opened so as to only allow flow back through pipe 32, past pop safety valve 10, an open valve 11, and pop safety valve 12 back into the liquid storage chamber 1.

At this time vapor valve 21 is opened, allowing flow from a source of preferrably $CO_2$ or air vapor 22 through pipe 36 past regulator 18 and through lubricator 17 into "air" motor 16. The motor 16 is started up by the flow of this vapor and begins to drive 4 to pump under relatively high pressure the liquid throughout the entire closed system described above.

Then, three-way valve 9 is opened so as to shut off flow through pipe 32 and direct the flow past the swivel connector 13, through the hose 33, which is attached through a cylinder connector 14 to a cylinder for its filling 15. The cylinder is set and supported on a scale 27 while filling. The cylinder 15 will be filled when the weight equals the weight-when-full reading.

When the cylinder 15 is filled, three-way valve 9 is turned to again allow flow through line 32, until another cylinder is connected to cylinder connector 14 for its filling, and the three-way valve sequence repeated. By use of the three-way valve 9, the pump prime is always maintained with no loss.

A second way the general system of the present invention can be used will now be described with reference to FIG. 2 and FIG. 3. In this second embodiment, the primary difference is that the three-way valve 25 is connected directly to the cylinder connector 14 (rather than through hose 33 as in FIG. 1) to prevent any undesirable or unacceptable losses of the gas in an intermediate hose such as 33 between the disconnection of one cylinder to the connection of the next cylinder.

As above, the liquid is drawn up from the liquid storage chamber 1 through the pipe 28 past the pop safety valve 2, when suction valve 3 is opened. The liquified gas then flows through pump chamber 4 into pipe 30, going past surge chamber 5.

At this point primer valve 8, containing rupture disk 7, is opened to let the gas flow through pipe 31 until liquid starts to flow out of opening 26. When liquid starts to flow, valve 8 is closed. Three-way valve 25 is opened so as to only allow flow back through hose 35 past swivel connector 24, and through pipe 32 past pop safety valve 10, valve 11 and pop safety valve 12 back into the liquid storage chamber 1.

At this time vapor valve 21 is full opened allowing flow from a source 22 of preferrably $CO_2$ or air vapor through pipe 36 past regulator 18 and through lubricator 17 into "air" motor 16. The motor 16 is then started by the flow of this vapor. The motor 16 drives the pump 4 which pumps the liquid throughout the entire closed system described above.

After about a minute's circulation to chill down all components and prevent vapor lock, the three-way selector valve 25 is opened so as to only allow flow through to the cylinder connector 14 to a cylinder 15 set on the scale 27 (not shown in FIGS. 2 to 3, but identical to that of FIG. 1). When the cylinder is filled, the three-way valve 25 is turned back to return flow to circulate the liquified gas again and the vapor valve 21 is partially closed back to provide low enough power to run the motor drive 16 and pump 4 slowly while circulating. The above sequence is then repeated for the next cylinder.

This second system "B" is especially useful and economical in the case of "Halon" or other expensive or toxic gases, and all fuel and hazardous gases, as disconnect/blow-down wastes are at an absolute minimum preventing waste, contamination, and hazard, and is thus more efficient and safe in terms of a lesser loss of the gas during pumping and fill.

FIG. 3 also shows that the system can be placed inside the enclosed 39 for liquid storage chamber 1, and that an efficient source of power for the "air" motor would be the evaporated vapor 22 from the liquid storage chamber 1 (in the case of $CO_2$) and the cylinder filling station 27–15 and located where necessary or desirable up to for exapmple a hundred feet away. The system of course need not be placed at the liquid storage chamber to use the vapor from within the chamber ($CO_2$). This remote system "B" is the preferred installation in cases where liquified gas storage 1 must be at relatively long distances from the scale/cylinder filling stations 27–15.

When all cylinder filling operations are completed, the vapor valve 21 is closed, shutting the motive part of the system down. After about fifteen to twenty minutes to allow all liquid remaining in the system to evaporate and return to the storage vessel 1, the liquid supply valve 3 and circulation-return valve 11 are closed.

Figure 4:
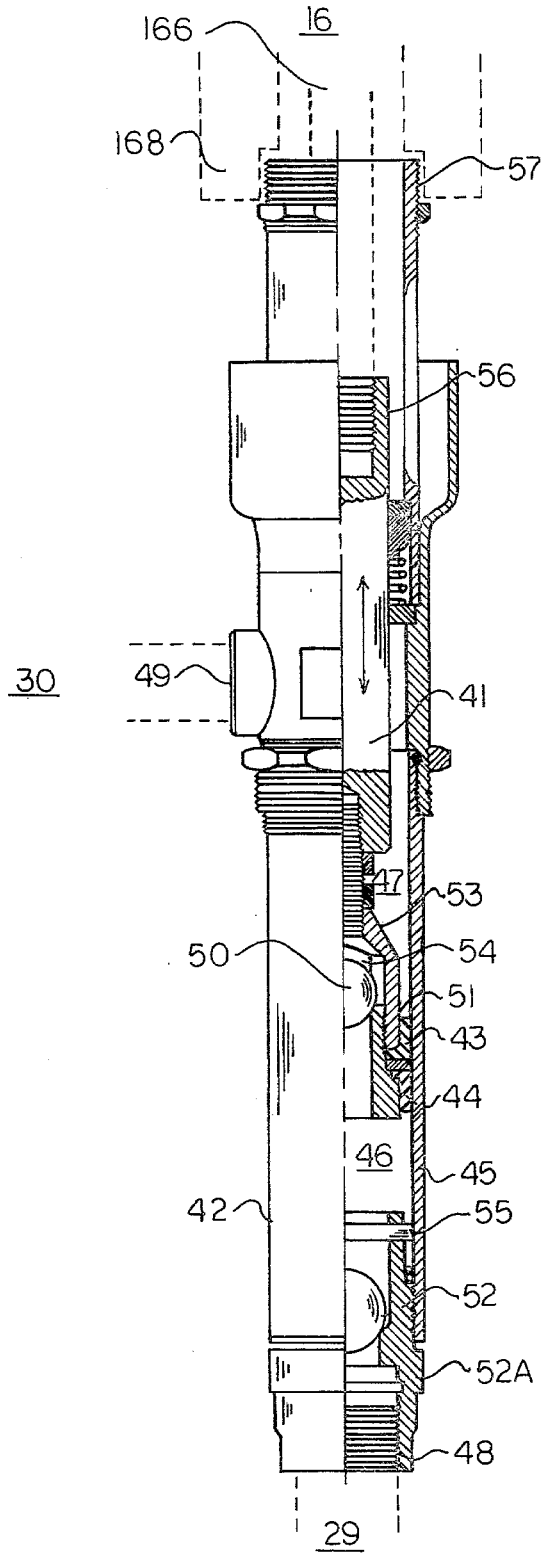
FIG. 4 is a side, partially cross-sectioned view of the preferred embodiment of the lower pump assembly through which the liquified gas is pumped used in the preferred embodiments of the system of the present invention.
Figure 5:
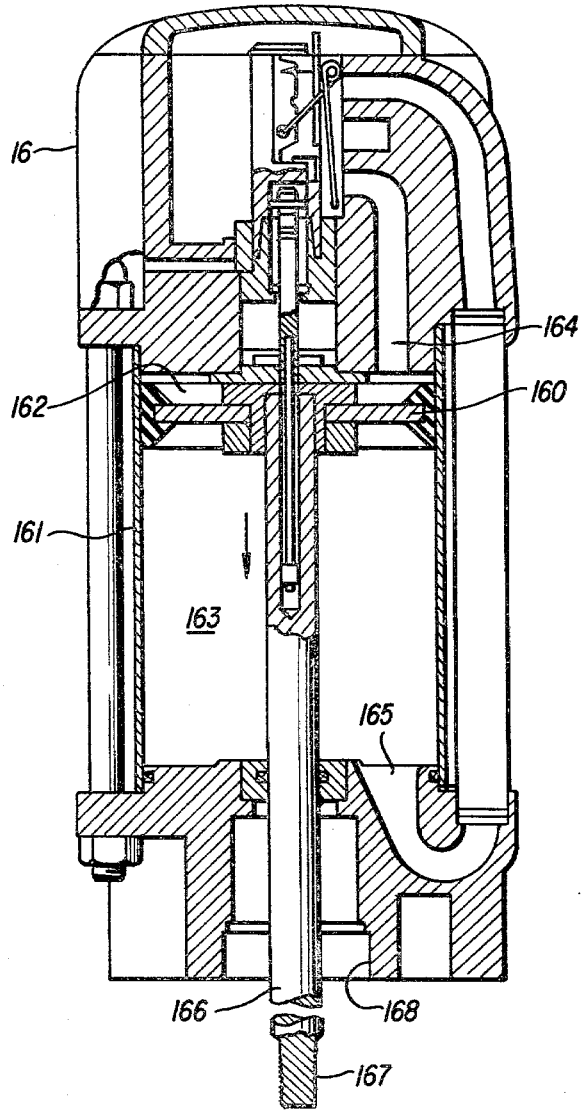
FIG. 5 is a side, cross-sectional view of the preferred embodiment of the air/$CO_2$ motor that drives the pump assembly of FIG. 4.

The system of the present invention preferrably includes a $CO_2$/air drive motor assembly 4 and pump 16, as illustrated in FIGS. 4 and 5, respectively, which are important parts of the present invention.

The pump 4 includes a longitudinally reciprocating plunger or piston 41 moving inside the pump cylinder or body 42, with the plunger 41 carrying an opposed set of cylindrical wiping cups 43 and 44 which bear against and scrub the inner cylindrical surface 45 of the body 42. The body 42 also includes a fill chamber 46, communicating with inlet line 48 and a pumping chamber 47 communicating with outlet 49.

One way check valves are formed by the upper ball 50 and its sealing seat 51 and lower ball 52 which seats against the inlet line 47. Upper ball 50 is retained in an area 54 adjacent its seat 51 by means of flat cage members 53 which do not extend three hundred and sixty degrees around the longitudinal axis of body 42 but rather allow relatively open fluid communication between the pumping chamber 47 and the confinement area 54. The lower ball 52 is confined in the lower part of the fill chamber 46 by means of lateral dowel pin 55.

The lower ball 52 seals off the inlet line 48 during the down-stroke of the plunger 41 but allows flow from the inlet line 48 into the fill chamber 46 during the upstroke; while the upper ball 50 with its seats 51 sealingly isolates the pumping chamber 47 from the fill chamber 46 during the upstroke, but allows flow from the fill chamber 46 to the pumping chamber 47 during the down-stroke. Thus, as the plunger 41 moves up the fluid in the pumping chamber 47 is pumped out the outlet 49 into the line 30, while the suction created in the lower fill chamber 46 draws a further charge of fluid in from the inlet line 48 into the fill chamber 46. On the down-stroke, the upper ball check valve 50–51 opens up and the fluid, which on the upstroke flowed into the fill chamber 46, flows into the pumping chamber 47 from the fill chamber 46, during which action the lower ball check valve 52–52A is closed. The plunger 41 develops pressure both ways, on the up-stroke and on the down-stroke. The up-stroke is also the suction or re-charge stroke. During the movement of the plunger 41 the cups 43 and 44 are extremely effective with liquified gas in their sealing and scrubbing actions.

It is noted that FIG. 4 illustrates the plunger 41 in its approximate mid-stroke position. The plunger 41 includes at its upper end a female threaded coupling 56 and a male threaded coupling 57 for attaching the plunger 41 and body 42, respectively to the drive motor 16.

The parts of the pump 4 (except for glands, seals and the cups 43, 44) are preferrably made of stainless steel, particularly the balls 50, 52, seats 51, 52A, plunger assembly 41 and the housing surface 45 and the cups 43, 44 made of "Teflon".

The drive motor 16 as illustrated in FIG. 5, includes a longitudinally reciprocating piston assembly 160 riding in "air" housing or cylinder 161. Pressurized air or other vapor is alternately asserted in upper chamber 162 and lower chamber 163 through air or vapor lines 164 and 165, respectively, causing the piston 160 to alternately move up and down. The cycling and sequencing is internally actuated and controlled by the valve assemblies illustrated.

The lower end 166 of the piston assembly 160 includes a male threaded member 167 which screws into the female coupling 56 of the plunger 41 of the pump 4. Likewise the male outer member 57 of the pump body 42 screws into and couples with the female threaded coupling 168 on the motor housing 161, locking the two units 4 and 16 together, with the movement of motor piston 160 causing a like movement of plunger 41.

In summary, the drive 4 produces reciprocating longitudinal movement of its piston assembly 160 under the alternating action of gas pressure being alternately asserted on either side of the piston causing it to move in response to the alternating upward and downward pressures. In turn the drive 4 causes the pump piston or plunger 41 to which piston assembly 160 is connected to longitudinally move up and down for pumping.

A suitable pump and suitable "air" motors for the system of the present invention are manufactured by Aro Corporation of Bryan Ohio as outlined:

| | |
|---|---|
| MODEL NO. 650408, | for high pressure, large capacity cylinders, and siphon-tube $CO_2$ cylinders (all fire extinguishers). |
| MODEL NO. 650308, | for gases utilizing medium pressure, high capacity cylinders (Halons, Freons). |
| MODEL NO. 560220-D, | for 20 lb. cap. $CO_2$ commercial cylinders and other compressed, liquified gases contained in medium pressure, medium or small capacity cylinders. |

All the above Aro Corporation, pump and motor models utilize the same basic pump body, ARO 65108. The CO2/air vapor motors vary in horsepower, stroke and size, depending on the model selected, and the work to be done.

As should be understood from all the foregoing, the present invention comprises a system for filling high pressure liquified gas (e.g. $CO_2$) cylinders from a low pressure liquified gas source. The system has been tested in actual use conditions and has performed very satisfactorily. The system is capable of rapid, reliable, economical and safe injection of for example, liquified $CO_2$, "Halon", "Freons", propane, butane, MAPP and other liquified fuel gases, chlorene, ammonia, $SO_2$, and other toxic and/or non-toxic liquified compressed gases.

All components used in the system should of course be of proper specifications to comply with all Compressed Gas Association recommendations for burst and working pressures required, and manufactured to S.A.E., A.S.M.E., and D.O.T. codes.

The phrase "liquified gases" as used herein refers of course to substances which in their normal ambient circumstances are in their gaseous state but due to the application of pressure and low temperatures are transformed to their liquid state.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A pumping system for filling relatively high pressure, liquified gas cylinders with a liquified gas, comprising:

a low pressure, enclosed source tank of liquified gas;

reciprocally driven, plunger-type pumping means for generating sufficient hydraulic pressure on the liquified gas from said tank source at the pressures required to rapidly fill high pressure cylinders;

pneumatic drive means connected to the plunger of said pumping means for reciprocally driving said pumping means;

source line means connecting said source and said pumping means together to supply liquified gas to said pump means;

cylinder connect means for connecting the cylinder to be filled to said pumping means; and cylinder line means connecting said connect means and said pumping means together to supply liquid gas under high pressure to said cylinder connect means and to any cylinder connected thereto;

multi-way valving means connected to at least one of said cylinder line means and said cylinder connect means; and return line means connecting said multi-way valving means and the source tank directly together for returning the liquified gas to the source tank when a cylinder is not being filled.

2. The system of claim 1, wherein there is included gas line means from the upper portion of said tank to said pneumatic drive means for supplying gas vapor formed from said liquified gas to said drive means for pneumatically driving it.

3. The system of claim 2, wherein said pneumatic drive means includes a piston reciprocally driven up and down within a cylindrical housing, said gas vapor being alternately asserted on opposite sides of said piston for causing it to move up and down.

4. The system of claim 1, wherein said plunger type pumping means comprises a plunger reciprocatingly driven in a cylindrical housing, said plunger carrying two scrubbing cups, one bearing against the circumference of the inner surface of said housing and the other downwardly.

5. The system of claim 4, wherein said pumping means includes an all stainless steel construction for its ball, plunger, seats, etc. with "Teflon" plunger packing and plunger cups.

6. A method of filling high pressure, liquified gas cylinders with liquified gas from a relatively low pressure liquified gas source, comprising the following steps:

(a) providing reciprocally driven, plunger-type pumping means from said tank source at the pressures required to rapidly fill such high pressure cylinders;

pneumatic drive means connected to the plunger of said pumping means for reciprocally driving said pumping means;

source line means connecting said source and said pump means;

cylinder line means connecting said connect means and said pump means together to supply the liquified gas under high pressure to said cylinder connect means and to any cylinder connected thereto;

multi-way valving means connected to at least one of said cylinder line means and said cylinder connect means; and return line means connecting said multi-way valving means and the source tank directly together for returning the liquified gas to the source tank when a cylinder is not being filled;

(b) allowing the liquified gas from the source to flow into said pumping means;

(c) pumping the liquified gas with the reciprocal action of the plunger of said pumping means under relatively high pressure to said cylinder connect means until the cylinder at said cylinder connect means is filled;

(d) changing the settings of said multi-way valving means so that the liquified gas is circulated back to the storage tank through said return line; and (e) returning said multi-way valving means to its original settings when another cylinder is connected to said cylinder connect means for filling it.

7. The method of claim 6, wherein in step "a" there is included the further step of providing gas line means from the upper portion of the storage tank to said pneumatic drive means; and wherein there is included the further step of (f) driving said pneumatic drive means with gas vapor from the storage tank through said gas line.

8. The method of claim 6, wherein in step "c" there is included the step of pumping the liquified gas by reciprocally driving said plunger altenately up and down.

* * * * *